United States Patent [19]

Piche

[11] 4,064,920

[45] Dec. 27, 1977

[54] TENON CUTTING MACHINE WITH CUTTING HEAD

[76] Inventor: Ernest Piche, 2 Forget St., St. Agathe, Canada

[21] Appl. No.: 734,736

[22] Filed: Oct. 21, 1976

[51] Int. Cl.[2] ..... B27F 1/08

[52] U.S. Cl. ..... 144/200; 83/471.2; 144/114 R; 144/218; 407/34

[58] Field of Search ..... 29/105 A; 83/471.2; 144/1 R, 36, 37, 114 R, 124, 117 R, 117 A, 117 B, 200, 134 R, 218, 219, 229, 198 R, 6, 133

[56] References Cited

U.S. PATENT DOCUMENTS

| | | | |
|---|---|---|---|
| 1,948,648 | 2/1934 | Buchmuller | 29/105 A |
| 2,917,089 | 12/1959 | Ennis | 83/471.2 X |

FOREIGN PATENT DOCUMENTS

| | | | |
|---|---|---|---|
| 548,244 | 9/1956 | Italy | 144/198 R |

*Primary Examiner*—Harrison L. Hinson
*Assistant Examiner*—W. D. Bray

[57] ABSTRACT

A cutting machine to form a tenon at each end of a piece of timber, which tenon has opposite faces which are inclined both longitudinally and transversely relative to the piece of timber and forming hereinafter called skew tenon faces. This tenon cutting machine is of simple construction and uses a single and simple cutting head to produce both skew tenon faces at each end of a piece of timber. This machine includes a bench to hold a piece of timber with one end thereof overhanging the bench, an arm pivotable operatively transversely to the piece of timber at this one end of the latter, a carriage slidable along the pivotable arm, a rotatable cutting head bodily displaceable with the carriage transversely of the piece of timber in any of two oblique directions relative to opposite faces of the piece of timber, a motor rotating the cutting head, one hydraulic cylinder selectively pivoting the arm for operative cutting displacement of the cutting head and carriage consecutively in the two oblique directions, in response to sliding of the carriage along the pivotable arm under the action of a second hydraulic cylinder.

4 Claims, 5 Drawing Figures

TENON CUTTING MACHINE WITH CUTTING HEAD

This invention relates to a tenon cutting machine of the type adapted to cut skew tenon faces on timber.

It has been proposed to make buildings and, in particular, the walls of buildings with solid pieces of timber wherein special tenon joints hold the pieces one to another. Such special tenon joint is defined in applicant's co-pending patent application Ser. No. 734,737 filed on Oct. 21, 1976.

This special tenon joint is formed by identical interlocking tenons, each on one end of cooperating pieces of timber. This tenon includes a pair of laterally opposite tenon faces which are inclined longitudinally but also transversely at the same angle relative to the piece of timber. These doubly inclined tenon faces are hereinafter identified as skew tenon faces. The two skew tenon faces at each end of any piece of timber are transversely inclined convergingly relative to each other and toward a mutual axis of transverse convergence.

It is a general object of the present invention to provide a tenon cutting machine which is of simple construction and operation and reliably produces the desired skew tenon faces.

It is another object of the present invention to provide a tenon cutting machine which uses a single cutting head and simple displacements of the latter relative to the pieces of timber to produce the desired skew tenon faces.

It is a more specific object of the present invention to provide a tenon cutting machine of the above type, wherein the two skew tenon faces at each end of a piece of timber are cut by a single cutting head of simple construction.

It is a further object of the present invention to provide a tenon cutting machine wherein the simple angular positioning of two cutting devices relative to each other and to a piece of timber allows to rapidly and reliably cut an afore-mentioned skew tenon face by a single and simple cutting head transversely to the piece of timber.

The afore-mentioned and other objects and advantages of the present invention will be better understood with reference to the following detailed description of preferred embodiments thereof which are illustrated by way of example, in the accompanying drawings, in which.

Figure 1:
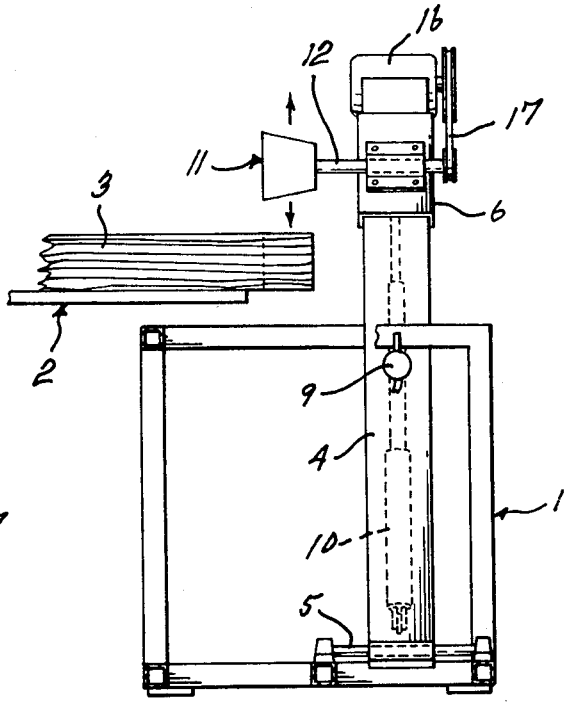
FIG. 1 is a front elevation view of a tenon cutting machine according to a first embodiment of the present invention.
Figure 2:
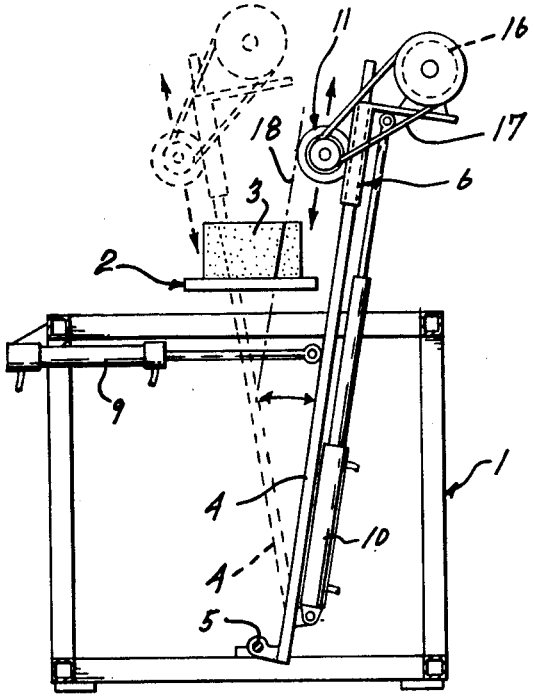
FIG. 2 is a side elevation view of the tenon cutting machine as seen from the right in FIG. 2.

The tenon cutting machine of FIGS. 1 and 2 includes a rigid frame 1, in the form of a framework of any conventional construction. This rigid frame 1 is fixedly secured on any appropriate base, such as on a floor. A timber carrying bench 2 is fixedly mounted adjacent the frame 1 and adapted to carry a piece of timber 3 at a cutting station with one end defining laterally opposite faces accessible for cutting therein.

An arm 4 is pivotally mounted on the frame 1 by a rod 5 extending parallel to the operatively carried piece of timber 3. Pivot rod 5 lies in a plane which is parallel to the laterally opposite faces of the piece of timber 3 and which passes through the longitudinal center line of said piece of timber. Thus, the arm 4 is pivotable transversely to the piece of timber 3 adjacent the afore-mentioned one end of the latter. A carriage 6 is slidably engaged with the pivotable arm 4 for reciprocative sliding displacement along the latter. The carriage 6 includes an L-shape member 7 and a plate 8 fixed together and cooperatively forming a slide engaged around the arm 4.

A first hydraulic cylinder 9 is connected to the frame 1 and to the arm 4 and operatively pivots the latter between two operative positions transversely relative to the piece of timber 3. A second hydraulic cylinder 10 is connected between the arm 4 and the carriage or slide 6 to operatively slide the latter reciprocatively up and down along the arm.

A cutting head 11 is operatively fixed on a shaft 12 for rotation therewith about an axis extending parallel to the piece of timber 3. The shaft 12 is rotatively mounted on the carriage, or slide 6, for bodily displacement therewith. The cutting head 11 includes a pair of cutters 13 which radially project from the body 14 diametrically opposite each other. Each cutter 13 has a cutting edge extending longitudinally of the axis of the cutting head 11 and of the piece of timber 3 and which is inclined longitudinally relative to the latter to define the longitudinal angle of inclination of the skew tenon faces. The cutting head 11 includes a second type of cutting means defined by a pair of routing cutters 15 fixed against the end of the body 14 at diametrically opposite positions relative to each other. These cutters 15 define a cutting line extending transversely of the piece of timber 3 and are thus adapted to form the transverse faces of the tenon which intersect the laterally opposite skew tenon faces respectively.

A motor 16 is mounted on the pivotable arm 4 and rotatively drives the shaft 12 and cutting heat 11 through a belt 17 and appropriate pulleys.

Figure 4:
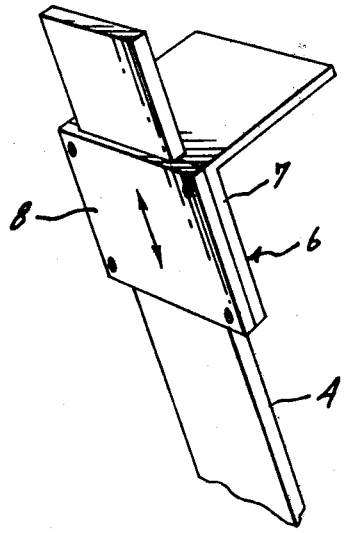
FIG. 4 is a perspective view of a carriage and supporting arm forming part of the tenon cutting machine of either afore-mentioned embodiments of the invention.
Figure 5:
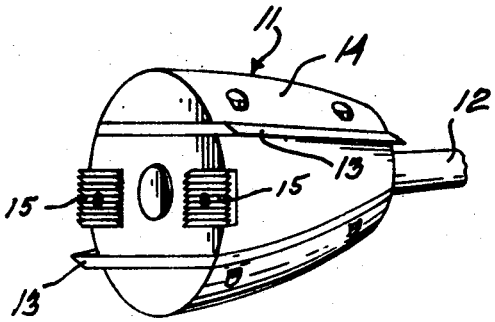
FIG. 5 is a perspective view of a cutting forming part of the tenon cutting machine of either afore-mentioned embodiments of the present invention.

Referring to the embodiment of FIGS. 1 and 2, and to FIGS. 4 and 5, it will be seen that a tenon is formed at one end of a piece of timber 3 by transversely registering this one end with the cutting head 11, by placing the arm 4 in one of its two angular positions relative to the piece of timber, and by simultaneously rotating the cutting head and bodily displacing the latter and the carriage 6 along the arm 4. The angle of the arm 4 defines the skew angle of the corresponding skew tenon face, as indicated by line 18 in FIG. 2. The cutters 13 define the longitudinal inclination of the tenon face. The other skew tenon face is cut after pivoting of the arm 4 to its other angular position which is equally but oppositely inclined with respect to the plane containing the pivot 5 and the longitudinal center line of the piece of timber 3. The two skew tenon faces thus obtained are equally inclined transversely of the piece of timber 3.

Figure 3:
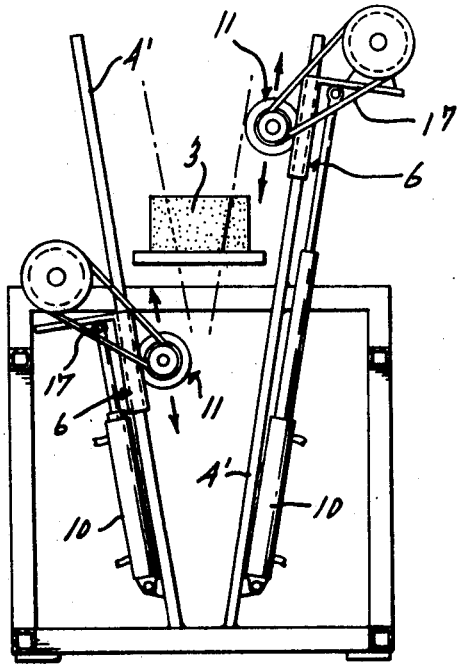
FIG. 3 is a side elevation view of a tenon cutting machine according to a second embodiment of the present invention.

In the embodiment of FIG. 3, the tenon cutting machine distinctively includes two arms 4' which are fixed at appropriate equally inclined angular positions relative to the piece of timber 3 to define two equally inclined skew angles on opposite sides respectively of the piece of timber.

Each fixed arm 4' carries a carriage 6, actuated by a hydraulic cylinder 10, a cutting head 11, a motor, a belt and the associated pulleys. It will be understood that the same number refers to an identical element in both embodiments.

With this second embodiment of the present invention, the two cutting heads 11 cut equally inclined tenon faces on the opposite sides respectively of the piece of timber 3 substantially at the same time.

What I claim is:

1. A tenon cutting machine for cutting a pair of opposite skew tenon faces at one end of a piece of timber, at a cutting station, with one end of said piece of timber defining laterally opposite faces accessible for cutting therein, said tenon cutting machine comprising a straight arm extending lengthwise transversely of said piece of timber adjacent said one end, said arm being pivotable transversely across said one end of the piece of timber between first and second inclined positions with respect to said laterally opposite faces, first actuation means for moving said arm back and forth from one to the other of said inclined positions, a carriage reciprocatively movable along said one arm, second actuation means connected to said one arm and to said carriage to operatively move the latter back and forth along said arm, a cutting head mounted on said carriage and bodily displaceable therewith transversely of said piece of timber upon reciprocating movement of said arm, said cutting head including a body rotating about an axis extending longitudinally of said piece of timber, at least one cutter radially projecting from said body and having a cutting edge extending longitudinally of the piece of timber, but inclined thereto, to cut a skew tenon face at one of said laterally opposite faces of said piece of timber, said cutting head body further having at one end face thereof at least one routing cutter having a cutting line extending transversely to the cutting axis of the cutting head and for cutting into said piece of timber a transverse face intersecting said skew tenon face, a motor mounted on said carriage and actuating said cutting head, whereby with said arm in one of said inclined positions, the rotating cutter head will cut one skew tenon face at one of said laterally opposite faces of said piece of timber during reciprocation movement of said cutter head and the rotating cutter will cut a second skew tenon face at the other of said laterally opposite faces of said piece of timber upon reciprocating movement of said carriage with said arm positioned in its other inclined position with respect to said piece of timber.

2. A tenon cutting machine as claimed in claim 1, wherein the pivot axis of said arm lies in a plane substantially parallel to said laterally opposite faces of said piece of timber at said cutting station and which passes through the longitudinal center line of said piece of timber and said first and second inclined positions of said arm are equally inclined on each side of said plane, so that said rotating cutting head will successively cut equally oppositely inclined skew tenon faces at the two laterally opposite faces of said piece of timber, a first skew tenon face being cut with said arm in one of said inclined positions and the other of said skew tenon faces being cut with said arm in the other of said inclined positions.

3. A tenon cutting machine for cutting a pair of opposite skew tenon faces at an end of a piece of timber, comprising a timber carrying bench adapted to support a piece of timber at a cutting station with one end of the piece of timber defining laterally opposite faces accessible for cutting therein, first and second straight arms fixedly secured relative to each other and to said timber carrying bench and oppositely inclined with respect to, and lying on, opposite sides of a plane which is parallel to said opposite lateral faces and which contains the longitudinal center line of said piece of timber at said cutting station, each straight arm extending lengthwise transversely to said piece of timber at said cutting station and adjacent one end of said piece of timber, a carriage movable along each arm, actuating means to move each carriage in a back-and-forth movement along each arm, a cutting head mounted on each carriage and bodily displaceable therewith transversely of said piece of timber, each cutting head including a body rotating about an axis extending longitudinally of said piece of timber, at least one cutter radially projecting from said body and having a cutting edge extending longitudinally of the piece of timber at an angle thereto, said body carrying at one end face thereof a routing cutter having a cutting line extending transversely to the axis of the cutting head, said cutter adapted to cut one skew tenon face and said routing cutter adapted to cut a transverse face intersecting said skew tenon face in one of said laterally opposite faces of said piece of timber, and an electric motor operatively rotating said cutting head, whereby the rotating cutting head will cut at the same time two opposite skew tenon faces and intersecting transverse faces at the two laterally opposite faces of said one end of said piece of timber at said cutting station upon movement of said carriages along the respective arms.

4. A tenon cutting face as claimed in claim 3, wherein said arms are equally inclined on each side of said plane and the resulting skew tenon faces are substantially equally inclined with respect to said laterally opposite faces at said one end of said piece of timber.

* * * * *